US011459852B2

(12) United States Patent
Taha

(10) Patent No.: US 11,459,852 B2
(45) Date of Patent: Oct. 4, 2022

(54) ACTUATING A FRANGIBLE FLAPPER RESERVOIR ISOLATION VALVE

(71) Applicant: Saudi Arabian Oil Company, Dhahran (SA)

(72) Inventor: Syed Muhammad Bin Syed Taha, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/903,917

(22) Filed: Jun. 17, 2020

(65) Prior Publication Data

US 2021/0396094 A1 Dec. 23, 2021

(51) Int. Cl.

*E21B 34/06* (2006.01)
*E21B 34/14* (2006.01)
*E21B 34/16* (2006.01)

(52) U.S. Cl.

CPC ..... *E21B 34/063* (2013.01); *E21B 34/14* (2013.01); *E21B 34/16* (2013.01); *E21B 2200/05* (2020.05)

(58) Field of Classification Search

CPC ..... E21B 34/14; E21B 34/063; E21B 34/16; E21B 2200/05

See application file for complete search history.

(56) References Cited

U.S. PATENT DOCUMENTS 3,051,243 A * 8/1962 Grimmer ..... E21B 34/14 166/332.7
3,749,119 A 7/1973 Watkins
4,009,753 A 3/1977 McGill et al.
4,043,392 A * 8/1977 Gazda ..... E21B 34/105 166/217
4,723,606 A * 2/1988 Vinzant ..... E21B 34/102 166/319
4,813,481 A 3/1989 Sproul et al.
(Continued)

FOREIGN PATENT DOCUMENTS

| | | |
|---|---|---|
| EP | 2142755 | 3/2016 |
| GB | 2257185 | 1/1993 |
| GB | 2452370 | 3/2009 |

OTHER PUBLICATIONS

PCT International Search Report and Written Opinion in International Appln. No. PCT/US2021/036852, dated Aug. 10, 2021, 13 pages.

*Primary Examiner* — Michael R Wills, III
(74) *Attorney, Agent, or Firm* — Fish & Richardson P.C.

(57) ABSTRACT

A method for wellbore fluid flow control in which a frangible flapper is disposed in a wellbore. The frangible flapper is engaged to a flow tube disposed within the wellbore to keep the frangible flapper in a biased open position to allow fluid flow through the wellbore. The method includes moving the flow tube longitudinally in a first direction within the wellbore and relative to the frangible flapper. The method includes responsive to moving the flow tube longitudinally in the first direction, disengaging the flow tube from the frangible flapper. The method includes responsive to disengaging the flow tube from the frangible flapper, causing the frangible flapper to move from the biased open position to an unbiased shut position. The method includes responsive to the frangible flapper moving to the unbiased shut position, stopping fluid flow within the wellbore from a downhole location downhole of the frangible flapper.

8 Claims, 6 Drawing Sheets

(56) References Cited

U.S. PATENT DOCUMENTS

| | | | | | |
|---|---|---|---|---|---|
| 4,846,281 | A * | 7/1989 | Clary | E21B 43/045 | 166/373 |
| 5,263,683 | A * | 11/1993 | Wong | E21B 34/14 | 166/332.4 |
| 5,823,265 | A * | 10/1998 | Crow | E21B 43/25 | 166/373 |
| 6,808,020 | B2 * | 10/2004 | Garcia | E21B 34/103 | 166/373 |
| 7,252,153 | B2 * | 8/2007 | Hejl | E21B 34/12 | 166/319 |
| 7,665,528 | B2 * | 2/2010 | Ross | E21B 34/103 | 166/373 |
| 8,424,611 | B2 * | 4/2013 | Smith | E21B 34/14 | 166/386 |
| 2002/0079104 | A1 * | 6/2002 | Garcia | E21B 34/06 | 166/373 |
| 2002/0134551 | A1 * | 9/2002 | Pringle | E21B 34/101 | 166/305.1 |
| 2004/0065442 | A1 * | 4/2004 | Myerley | E21B 34/106 | 166/373 |
| 2006/0124315 | A1 * | 6/2006 | Frazier | E21B 34/06 | 166/369 |
| 2006/0283791 | A1 * | 12/2006 | Ross | B01D 35/02 | 210/429 |
| 2015/0240596 | A1 * | 8/2015 | Horwell | E21B 34/16 | 166/332.8 |
| 2017/0218722 | A1 * | 8/2017 | Gordon | E21B 33/134 | |

* cited by examiner

ACTUATING A FRANGIBLE FLAPPER RESERVOIR ISOLATION VALVE

TECHNICAL FIELD

This disclosure relates to controlling fluid flow in a reservoir, for example, one in which hydrocarbons are entrapped and through which a wellbore is formed to produce the entrapped hydrocarbons.

BACKGROUND OF THE DISCLOSURE

A completion assembly is the physical hardware and equipment used to extract naturally occurring oil and gas deposits from the Earth and move the oil and gas to the surface of the Earth through a wellbore after the wellbore has been drilled in the Earth by a drilling rig. Completing a wellbore is the process of disposing or placing the completion equipment within the wellbore. A wellbore can pass through multiple layers of Earth, and multiple layers may or may not contain oil and gas deposits. A layer of Earth that contains oil and gas deposits is a reservoir. Oil and gas reservoirs and other layers also contain other fluids such as water. In some instances, it is desired to isolate the flow of a fluid within the wellbore between a reservoir and the surface or between from one layer of the Earth to another layer of the Earth.

SUMMARY

This disclosure describes technologies related to actuating a frangible flapper reservoir isolation valve. Implementations of the present disclosure include a method for wellbore fluid flow control in a wellbore in which a frangible flapper is disposed. The frangible flapper is engaged to a flow tube disposed within the wellbore to keep the frangible flapper in a biased open position within the wellbore to allow fluid flow through the wellbore. The method for wellbore fluid flow control includes moving the flow tube longitudinally in a first direction within the wellbore and relative to the frangible flapper. The method for wellbore fluid flow control includes responsive to moving the flow tube longitudinally in the first direction, disengaging the flow tube from the frangible flapper. The method for wellbore fluid flow control includes responsive to disengaging the flow tube from the frangible flapper, causing the frangible flapper to move from the biased open position to an unbiased shut position within the wellbore. The method for wellbore fluid flow control includes responsive to the frangible flapper moving to the unbiased shut position, stopping fluid flow within the wellbore from a downhole location downhole of the frangible flapper.

In some implementations, the flow tube includes a flow tube locking dog. The frangible flapper valve body disposed within the wellbore defines a first notch. The flow tube locking dog is engaged to the first notch to engage the frangible flapper valve body to the flow tube and to maintain the frangible flapper in the biased open position allowing fluid flow.

In some implementations, disengaging the flow tube from the frangible flapper responsive to longitudinally moving the flow tube in the first direction includes disengaging the flow tube locking dog from the first notch.

In some implementations, the flow tube is moved until the flow tube locking dog engages a second notch defined by the frangible flapper valve body and spaced apart from the first notch on the frangible flapper valve body. The frangible flapper transitions from the biased open position to the unbiased shut position.

In some implementations, in the wellbore in which the frangible flapper is disposed, the frangible flapper is disengaged from the flow tube disposed within the wellbore to keep the frangible flapper in the unbiased shut position within the wellbore to prevent fluid flow through the wellbore, the method for wellbore fluid flow control includes moving the flow tube longitudinally in a second direction opposite the first direction within the wellbore and relative to the frangible flapper. The method includes, responsive to moving the flow tube longitudinally in the second direction, engaging the flow tube to the frangible flapper. The method includes, responsive to engaging the flow tube, causing the frangible flapper to move from the unbiased shut position to the biased open position within the wellbore. The method includes, responsive to the frangible flapper moving to the biased open position, allowing fluid flow within the wellbore.

In some implementations, the flow tube includes a flow tube locking dog, the frangible flapper valve body defines a second notch, and the flow tube locking dog is engaged to the second notch to engage the frangible flapper valve body to the flow tube to allow the frangible flapper to transition from the biased open opposition to the unbiased shut position preventing fluid flow.

In some implementations, engaging the flow tube to the frangible flapper responsive to longitudinally moving the flow tube in the second direction includes disengaging the flow tube locking dog from the second notch.

In some implementations, the flow tube is moved until the flow tube locking dog engages a first notch defined by the frangible flapper valve body spaced apart from the second notch on the frangible flapper valve body and to maintain the frangible flapper in the biased open position allowing fluid flow.

In some implementations, the flow tube defines a notch. Moving the flow tube longitudinally in the first direction includes coupling a shifting tool to the notch defined by the flow tube to a key and jarring the shifting tool and the flow tube in the first direction to disengage the flow tube locking dog from the first notch of the frangible flapper valve body.

In some implementations, where the flow tube defines the notch, moving the flow tube longitudinally in a second direction opposite the first direction within the wellbore and relative to the frangible flapper includes coupling the shifting tool to the notch of the flow tube, where the shifting tool is coupled to the notch of the flow tube with the key and jarring the shifting tool and the flow tube in the second direction to disengage the flow tube locking dog from the second notch of the frangible flapper valve body.

In some implementations, the wellbore fluid flow control includes moving the shifting tool within the wellbore using a slickline cable or a coiled tubing.

In some implementations, the wellbore fluid flow control method includes destroying the frangible flapper to re-open fluid flow through the wellbore.

In some implementations, the wellbore fluid flow control method includes destroying the frangible flapper with a blind box or a completion tubing tailpipe.

Further implementations of the present disclosure include a wellbore flow control assembly including a frangible flapper, a flow tube, and a frangible flapper valve body. The frangible flapper is configured to be installed in a wellbore and to transition between an unbiased position in which the frangible flapper is configured to prevent fluid flow through the wellbore in response to a fluid flow from an downhole location downhole of the frangible flapper and a biased position in which the frangible flapper is configured to allow fluid flow through the wellbore. The flow tube is configured to be installed in the wellbore and to be engaged to the frangible flapper to dispose the frangible flapper in the biased position and to disengage from the frangible flapper to dispose the frangible flapper in the unbiased position. The a frangible flapper valve body is configured to be installed in the wellbore and to be engaged to the flow tube to maintain the frangible flapper in either the biased position or the unbiased position and to be disengaged from the flow tube to transition the frangible flapper between the biased position and the unbiased position.

In some implementations, the flow tube includes a flow tube locking dog. The frangible flapper valve body defines a first notch and a second notch. The flow tube locking dog is configured to engage the first notch to maintain the frangible flapper in the biased position, to engage the second notch to maintain the frangible flapper in the unbiased position, and to remain disengaged with the first notch and the second notch to transition the frangible flapper between the biased position and the unbiased position.

In some implementations, the wellbore flow control assembly includes a shifting tool configured to be lowered into the wellbore and to engage the flow tube to transition the frangible flapper between the biased position and the unbiased position.

In some implementations, the shifting tool includes a key. The flow tube defines a notch. The key is configured to engage the notch to transition the flow tube between the biased position and the unbiased position.

In some implementations, the wellbore flow control assembly includes a biasing mechanism coupling the frangible flapper to the frangible flapper valve body. The biasing mechanism is configured to transition the frangible flapper between the biased position and the unbiased position.

In some implementations, the biasing mechanism comprises a spring.

In some implementations, the wellbore flow control assembly includes a blind box on a slickline or a completion tubing tailpipe configured to be lowered into the wellbore to destroy the frangible flapper when the frangible flapper is in the unbiased position.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION OF THE DISCLOSURE

Figure 1A:
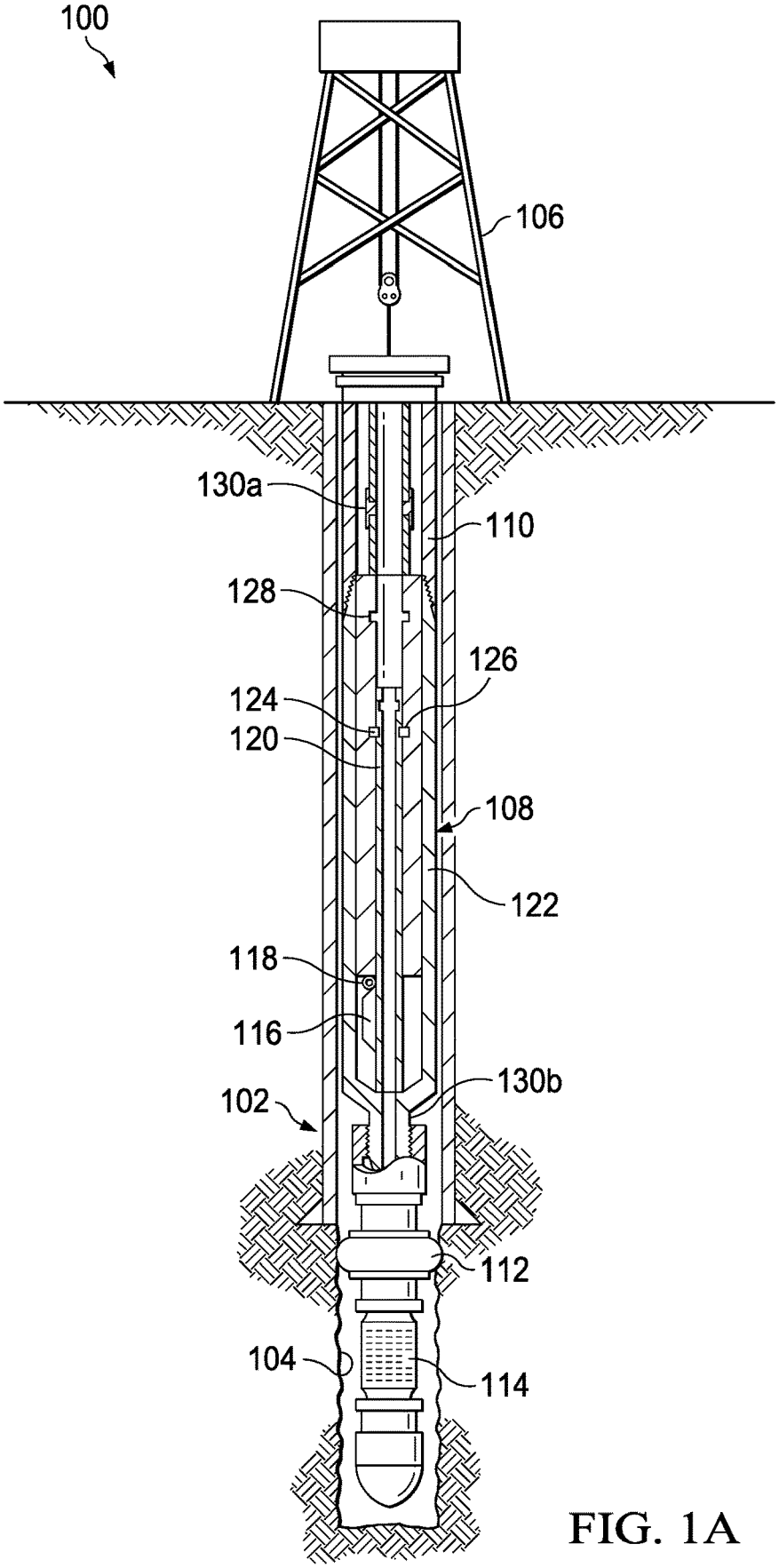
FIG. 1A is a schematic view of a frangible flapper reservoir isolation valve with the frangible flapper in the open position integrated into a completion assembly installed in a wellbore.

The present disclosure relates to a frangible flapper reservoir isolation valve placed in a wellbore as part of a completion assembly after the wellbore has been drilled in the Earth by a drilling rig. The wellbore can pass through multiple layers of Earth, and multiple layers may or may not contain oil and gas deposits. A layer of Earth that contains oil and gas deposits is a reservoir. Oil and gas reservoirs and other layers also contain other fluids such as water. A reservoir isolation valve is placed in the completion assembly at the desired location to isolate the flow of a fluid from one layer of the Earth to another layer of the Earth. A flapper valve is a type of valve where the flapper is the sealing element. The flapper can be placed in an unbiased position or a biased position. In the unbiased position, the flapper prevents a fluid flow in one direction, but allows a fluid flow in the other direction. In the biased position, the flapper is held open allowing continual fluid flow. The flapper can be constructed of a frangible material. A frangible material maintains its structural integrity under nominal operating conditions, but can be destroyed when desired by placing the material in a specific operating condition. For example, a frangible material can be destroyed by a force such as a physical impact or a pressure increase above a designed set point.

The wellbore fluid flow is controlled by the position of the frangible flapper. In some implementations, the frangible flapper starts in the biased open position. As described in detail with reference to the following figures, a flow tube is engaged to the frangible flapper where the flow tube holds the frangible flapper in a biased open position within the wellbore to allow fluid flow through the wellbore. The flow tube is moved longitudinally in one direction away from the frangible flapper within the wellbore and relative to the frangible flapper. Moving the flow tube longitudinally away from the flapper causes the flow tube to disengage from the frangible flapper. Disengaging the flow tube from the frangible flapper causes the frangible flapper to move from the biased open position to an unbiased shut position within the wellbore. Moving the frangible flapper to the unbiased shut position stops fluid flow within the wellbore from a downhole location downhole of the frangible flapper.

With the frangible flapper in the unbiased shut position, fluid flow is reestablished by moving the flow tube longitudinally in the opposite direction within the wellbore and relative to the frangible flapper. Moving the flow tube longitudinally in the opposite direction engages the flow tube to the frangible flapper. Engaging the flow tube to the frangible flapper causes the frangible flapper to move from the unbiased shut position to the biased open position within the wellbore. Moving the frangible flapper to the biased open position allows fluid flow within the wellbore.

The flow tube is moved longitudinally within the wellbore by coupling a shifting tool to the flow tube. The shifting tool is coupled to a slickline cable or a coiled tubing attached to the drilling rig on the surface of the Earth. The shifting tool is jarred to move the flow tube.

Implementations of the present disclosure realize one or more of the following advantages. Additionally, retrieving a downhole barrier requires a long time period, increasing well construction costs. The frangible flapper reservoir isolation valve can be placed in the wellbore before or after wellbore stimulation and flowback during the wellbore completion process, providing greater operational flexibility. Wellbore stimulation is a treatment to the wellbore to improve the fluid flow of oil and gas from the Earth into the wellbore. Flowback is a period of time following wellbore stimulation when fluid flows through the completion assembly to the surface of the Earth to be collected. Also, minimal intervention in the completion is required for flapper valve operations like closing and opening the flapper or destroying the flapper. The frangible flapper reservoir isolation valve is less expensive than retrievable downhole barriers. Examples of expensive retrievable downhole barriers are bridge plugs and ball valves.

Figure 1B:
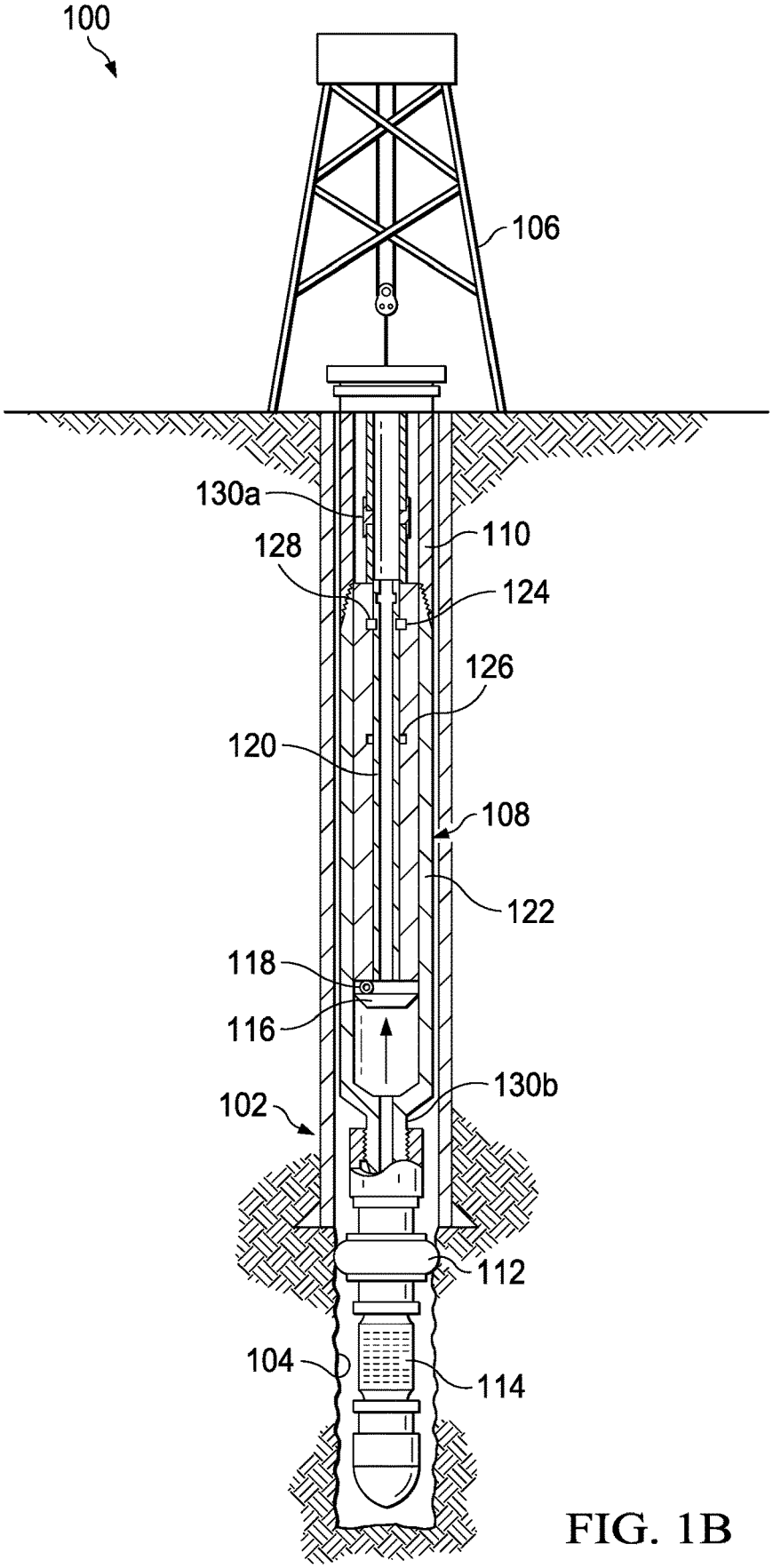
FIG. 1B is a schematic view of the frangible flapper reservoir isolation valve with the frangible flapper in the shut position integrated into the completion assembly installed in the wellbore of FIG. 1.

Referring to FIGS. 1A and 1B, a wellbore fluid flow control system 100 is shown. A completion assembly 102 is disposed in a wellbore 104 drilled in the Earth by a drilling rig 106. The completion assembly 102 includes a frangible flapper reservoir isolation valve 108 to control fluid flow within the wellbore 104. The completion assembly 102 can include other completion equipment. For example, the completion assembly 102 can include tubing 110 to conduct fluids, packers 112 to seal the annular region between the completion assembly 102 and the wellbore 104, screens 114 to filter particulates and similar equipment of a completion assembly. The tubing 110 can be a liner or a casing.

A frangible flapper 116 is included in the frangible flapper reservoir isolation valve 108 to seal flow through the completion assembly 102. The frangible flapper 116 can transition between a biased position shown in FIG. 1A and an unbiased position shown in FIG. 1B. In the biased position, as shown in FIG. 1A, the frangible flapper 116 is held open allowing fluid flow through the wellbore 104. Fluid flow within the wellbore 104 and completion assembly 102 can be based on a pressure difference between the wellbore 104 in fluid contact with oil, gas, and water producing formations, the surface of the Earth, and drilling rig equipment. Examples of drilling rig equipment include drilling fluid pumps or pumps used to fracture formations. With the frangible flapper in the biased position, fluid can flow in an uphole direction or a downhole direction within the completion assembly 102. An uphole direction is the direction toward a surface of the Earth. A downhole direction is the direction in the well away from the surface of the Earth. In the unbiased position, as shown in FIG. 1B, the frangible flapper 116 prevents a fluid flow in one direction, but allows a fluid flow in the other direction. Fluid flow in an uphole direction within the completion assembly 102 is prevented by the frangible flapper. A fluid flow in a downhole direction within the completion assembly pivots the frangible flapper 116 about a joint 118, allowing fluid to flow.

As shown in FIG. 1A, the frangible flapper 116 is engaged to a flow tube 120 disposed within the wellbore 104. The flow tube 120 is a hollow tube to permit fluid flow. The flow tube 120 is configured to keep the frangible flapper 116 in a biased open position to allow fluid flow through the wellbore 104.

The flow tube 120 moves longitudinally within a frangible flapper valve body 122 to move the frangible flapper 116 from a biased open position to an unbiased closed position. A frangible flapper valve body 122 is disposed within the wellbore 104. The frangible flapper valve body 122 is mechanically coupled to the completion assembly 102 and retains components of the wellbore fluid flow control system 100. The flow tube 120 moves longitudinally within the frangible flapper valve body 122 in the opposite direction to move the frangible flapper 116 from the unbiased closed position to the biased open position. The frangible flapper 116 and flow tube 120 are disposed within a frangible flapper valve body 122. The flow tube 120 includes a flow tube locking dog 124, and the flapper valve body 122 defines a void that engages the flow tube locking dog 124. The locking dog prevents movement by placing a physical body to engage the void. The frangible flapper valve body 122 defines a first notch 126 to engage the flow tube locking dog 124. The flow tube locking dog 124 engages the first notch 126 to engage the frangible flapper valve body 126 to the flow tube 120 and to maintain the frangible flapper 116 in the biased open position allowing fluid flow. The first notch 126 can also be referred to as the locked notch because when the flow tube locking dog 124 is engaged to the first notch 126, the frangible flapper valve body 126 is engaged to the flow tube 120 which is engaged to the frangible flapper 116 in the locked, biased open position. The frangible flapper valve body 122 defines a second notch 128 spaced apart from the first notch 126 on the frangible flapper valve body 122. The flow tube 120 is moved until the flow tube locking dog 124 engages the second notch 128, transitioning the frangible flapper from the biased open position (FIG. 1A) to the unbiased shut position (FIG. 1B). The second notch 128 can also be referred to as the released notch because when the flow tube locking dog 124 is engaged to the second notch 128, the flow tube 120 is disengaged from the frangible flapper 116, and the frangible flapper 116 is in the released, unbiased open position and free to move in response to a fluid flow from an uphole direction uphole of the flapper valve 116.

Referring to FIGS. 1A and 1B, the frangible flapper reservoir isolation valve 108 is mechanically coupled to the completion tubing 110 by a mechanical connector 130. The frangible flapper reservoir isolation valve 108 can be connected to the completion tubing 110 with an uphole connection 130*a* and a downhole connection 130*b*. The completion tubing can be a tube, a casing, or a liner. A casing can be steel or cement. A steel or cement casing is capable of withstanding well conditions and well fluid pressures. The mechanical connector 130 can be a standard API (American Petroleum Institute) rotary shouldered pin connector. The standard API rotary shouldered connector is a regular connection, a numeric connection, an internal flush connection, or a full hole connection. The pin connection can be a manufacturer proprietary design. The mechanical connector 130 can be a box connection, where the threads are internal to the box. The mechanical connector 130 can have an outer diameter corresponding to a standard American Petroleum Institute connection size. For example, the mechanical connector 130 can have an outer diameter of 4½ inches, 5½ inches, 6⅝ inches, 7 inches, 7⅝ inches, 8⅝ inches, 9⅝ inches, 10¾ inches, 11¾ inches, or 13⅜ inches.

The frangible flapper 116 is constructed of a frangible material. A frangible material maintains its structural integrity under normal operating conditions, but can be destroyed when desired by placing the material in a specific operating condition. For example, a frangible material can be destroyed by a force such as a physical impact, a pressure increase above a designed set point, or a temperature increase above a designed set point. The frangible flapper 116 can be constructed of a ceramic material, a glass material, a metallic material, or a composite of multiple materials.

Figure 2A:
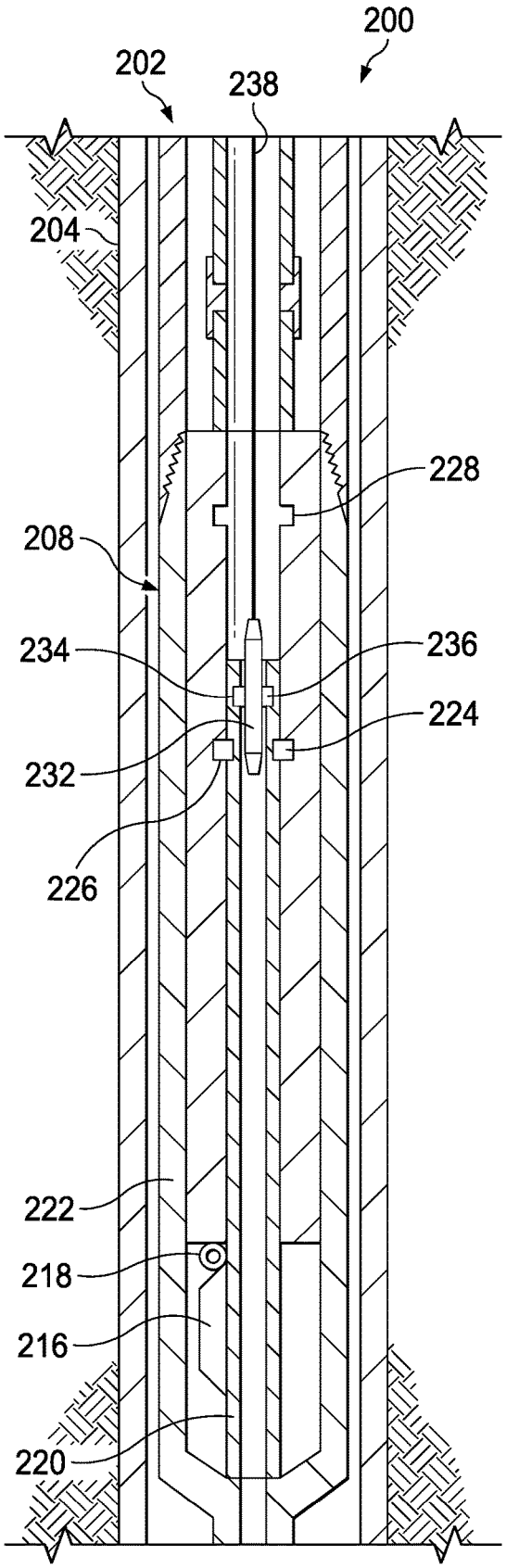
FIG. 2A is a schematic view of the frangible flapper reservoir isolation valve of FIGS. 1A and 1B with the frangible flapper in the open position coupled to a shifting tool.
Figure 2B:
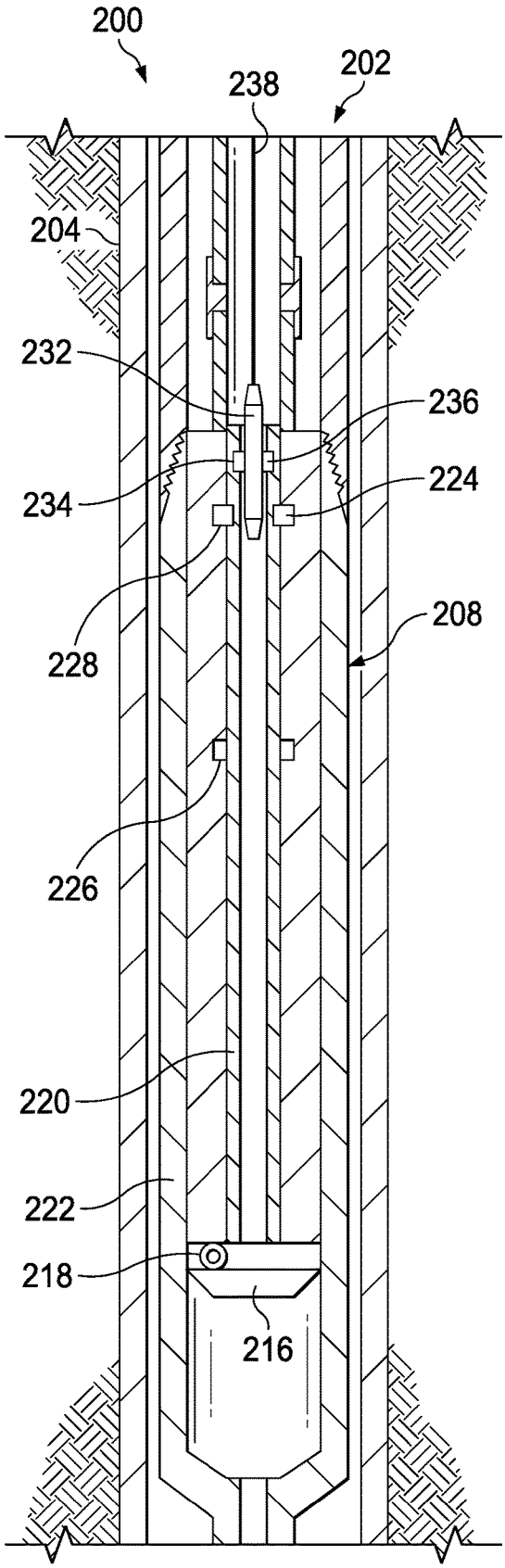
FIG. 2B is a schematic view of the frangible flapper reservoir isolation valve of FIGS. 1A and 1B with the frangible flapper in the shut position coupled to a shifting tool.

Referring to FIGS. 2A and 2B, a wellbore fluid flow control system 200 mechanically coupled to a shifting tool 232 is shown. The wellbore fluid flow control system 200 is substantially identical to wellbore fluid flow control system 100 described earlier with reference to FIGS. 1A and 1B. The shifting tool 232 is coupled to the wellbore fluid control system 200 to change the position of the frangible flapper 216. A completion assembly 202 is disposed in a wellbore 204. The completion assembly 202 includes a frangible flapper reservoir isolation valve 208 to control fluid flow within the wellbore 204. The frangible flapper 216 is disposed in the frangible flapper reservoir isolation valve 208 to seal flow through the completion assembly 202. The shifting tool 232 operates the frangible flapper reservoir isolation valve 208 to control fluid flow within the wellbore 204. The shifting tool 232 has a key 236. The shifting tool 232 is mechanically coupled to a notch 234 on the flow tube 220 to move the flow tube 220 longitudinally. The shifting tool 232 is mechanically coupled to the shifting tool notch 234 by the key 236.

The frangible flapper 216 can be in a biased position as shown in FIG. 2A or an unbiased position shown in FIG. 2B. In the biased position, as shown in FIG. 2A, the frangible flapper 216 is held open allowing fluid flow. With the frangible flapper 216 in the biased position, fluid can flow in an uphole direction or a downhole direction within the completion assembly 202. In the unbiased position, as shown in FIG. 2B, the frangible flapper 216 prevents a fluid flow in one direction, but allows a fluid flow in the other direction.

Referring to FIGS. 2A and 2B, the flow tube 220 defines a notch 234. Jarring the shifting tool 232 and the flow tube 220 longitudinally in the first direction disengages the flow tube locking dog 224 from the first notch 226. Jarring is the application of a force in a rapid repeating manner. Jarring the shifting tool 232 and the flow tube 220 longitudinally in the second direction disengages the flow tube locking dog 224 from the second notch 228. The shifting tool 232 is mechanically coupled to a slickline cable 238. The shifting tool 232 can also be mechanically coupled to a coiled tubing. The slickline cable 238 or the coiled tubing moves the shifting tool 232 within the wellbore 204 to move the frangible flapper 216 from the unbiased position to the biased position and from the biased position to the unbiased position.

Figure 3:
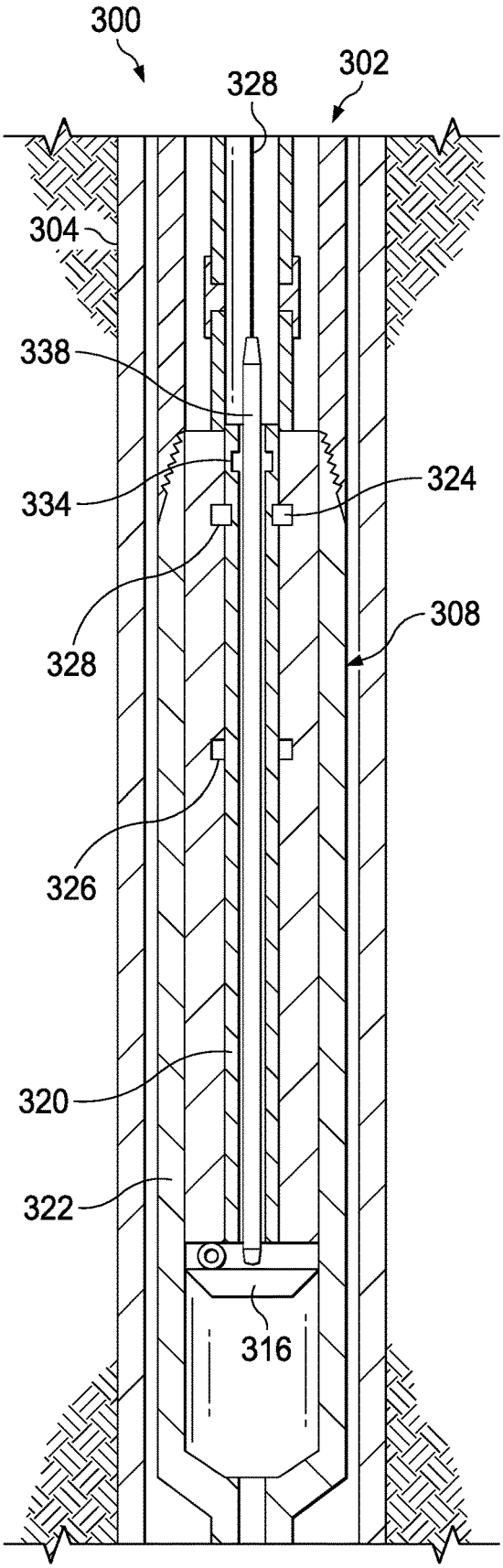
FIG. 3 is a schematic view of the frangible flapper reservoir isolation valve of FIGS. 1A and 1B with a blind box aligned to destroy the frangible flapper.

FIG. 3 shows a wellbore fluid flow control system 300 with a completion assembly 302 including a blind box 338 is disposed in a wellbore 304. The wellbore fluid flow control system 300 is substantially identical to wellbore fluid flow control system 100 described earlier with reference to FIGS. 1A and 1B. The completion assembly 302 includes a frangible flapper reservoir isolation valve 308 to control fluid flow within the wellbore 304. The frangible flapper 316 is disposed in the frangible flapper reservoir isolation valve 308 to seal flow through the completion assembly 302. The frangible flapper valve body 322 defines the second notch 328 spaced apart from the first notch 326 on the frangible flapper valve body 322. The flow tube 320 is clear of the frangible flapper 316. The flow tube locking dog 324 is engaged to the second notch 328. The frangible flapper 316 in the released unbiased shut position and free to move in response to a fluid flow from an uphole direction uphole of the flapper valve 316. The blind box 338 can move in a downhole direction from uphole of the frangible flapper reservoir isolation valve 308 to impact the frangible flapper 316. The blind box 338 impacting the frangible flapper 316 destroys the frangible flapper 316, reopening fluid flow through the wellbore.

Referring to FIGS. 2A and 2B, the wellbore fluid flow control system 200 can be a wellbore flow control assembly. The wellbore flow control assembly contains a frangible flapper 216, a flow tube 220, and a frangible flapper valve body 222. The wellbore flow control assembly has a biasing mechanism 218 coupling the frangible flapper 216 to the frangible flapper valve body 222. The biasing mechanism 218 is configured to transition the frangible flapper 216 between the biased position and the unbiased position. For example, the biasing mechanism 218 can be a spring.

Referring to FIG. 3, the wellbore flow control assembly 300 can have a blind box 338 mechanically coupled to a slickline cable 328. The blind box 338 can also be mechanically coupled to a coiled tubing. The blind box 338 is configured to be lowered into the wellbore to destroy the frangible flapper 316 when the frangible flapper 316 is in the unbiased position. Alternatively, a completion tubing tailpipe can be substituted for the blind box 338 to destroy the frangible flapper 316.

Figure 4:
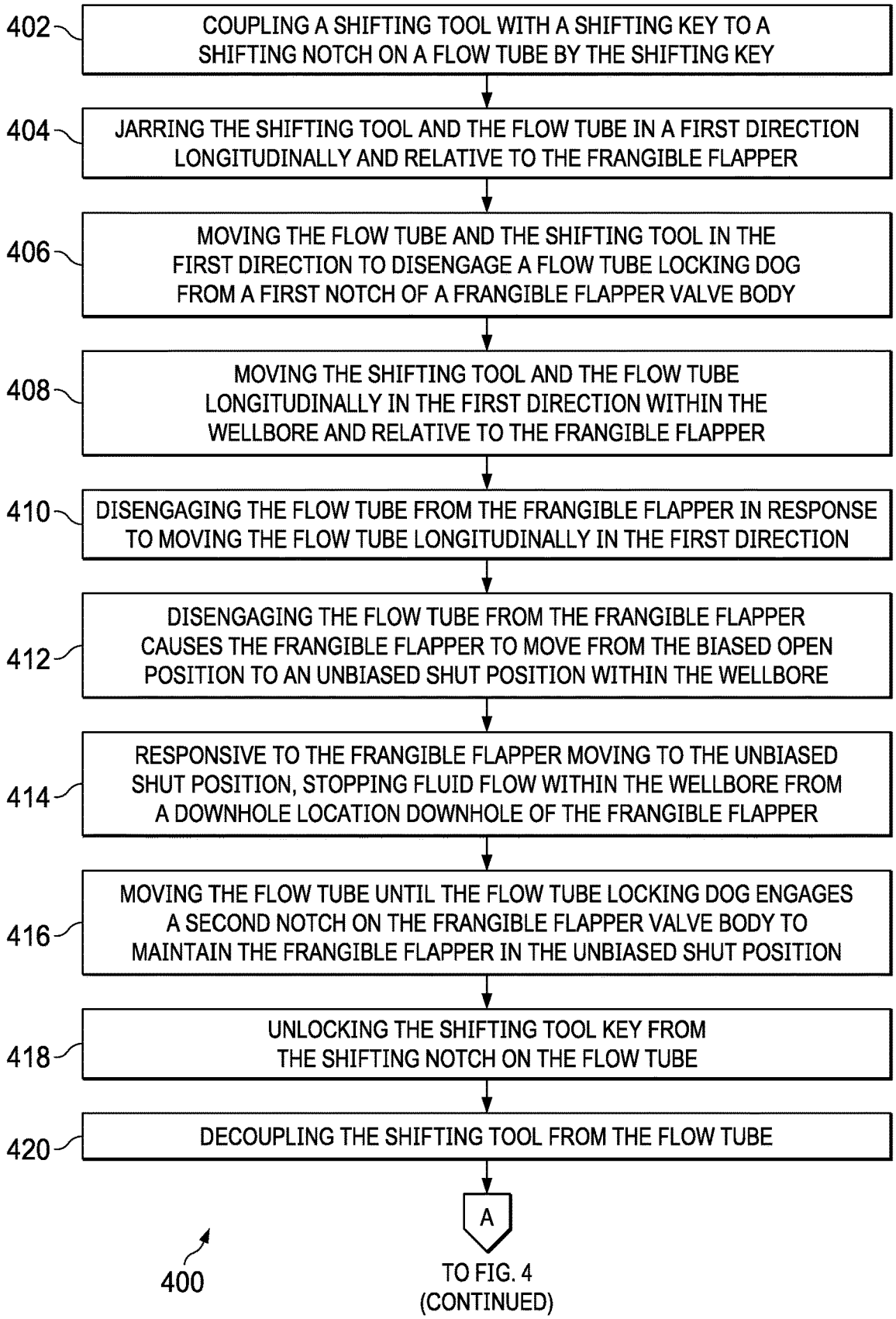
FIG. 4 is a flow chart of an example method of operating a frangible flapper reservoir isolation valve of FIGS. 1A and 1B.
Figure 4:
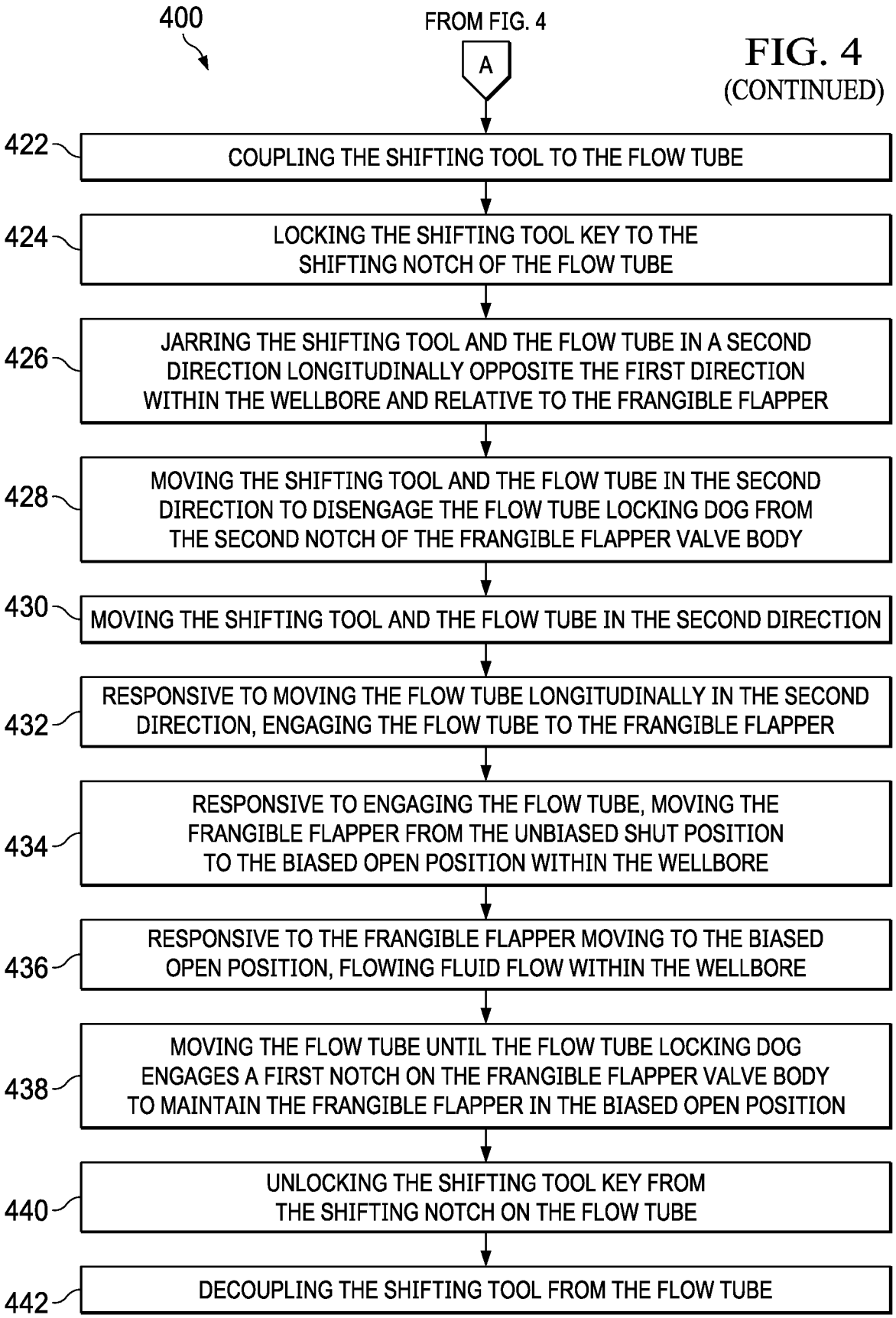

FIG. 4 is a flow chart of an example method 400 of controlling wellbore fluid flow in a wellbore in which a frangible flapper is disposed. The frangible flapper is engaged to a flow tube disposed within the wellbore to keep the frangible flapper in a biased open position within the wellbore to allow fluid flow through the wellbore. The frangible flapper can be disengaged from the flow tube to keep the frangible flapper in the unbiased shut position to prevent fluid flow through the wellbore according to the implementations of the present disclosure. At 402, a shifting tool with a shifting key is coupled to a shifting notch on a flow tube by the shifting key. At 404, the shifting tool jars the flow tube in a first direction longitudinally and relative to the frangible flapper. At 406, the flow tube and the shifting tool move in the first direction to disengage a flow tube locking dog from a first notch of a frangible flapper valve body. At 408, the shifting tool and the flow tube move longitudinally in the first direction within the wellbore and relative to the frangible flapper. At 410, the flow tube disengages from the frangible flapper in response to moving the flow tube longitudinally in the first direction. At 412, in response to disengaging the flow tube, the frangible flapper moves from the biased open position to an unbiased shut position within the wellbore. At 414, responsive to the frangible flapper moving to the unbiased shut position, fluid flow stops within the wellbore from a downhole location downhole of the frangible flapper. At 416, the flow tube is moved until the flow tube locking dog engages a second notch on the frangible flapper valve body to maintain the frangible flapper in the unbiased shut position. At 418, the shifting tool key unlocks from the shifting notch on the flow tube. At 420, the shifting tool is decoupled from the flow tube. At 422, the shifting tool couples to the flow tube. At 424, the shifting tool key locks to the shifting notch of the flow tube. At 426, the shifting tool jars the flow tube in a second direction longitudinally opposite the first direction within the wellbore and relative to the frangible flapper. At 428, the shifting tool and the flow tube move in the second direction to disengage the flow tube locking dog from the second notch of the frangible flapper valve body. At 430, the shifting tool and the flow tube move in the second direction. At 432, responsive to moving the flow tube longitudinally in the second direction, the flow tube engages to the frangible flapper. At 434, responsive to engaging the flow tube, the frangible flapper moves from the unbiased shut position to the biased open position within the wellbore. At 436, responsive to the frangible flapper moving to the biased open position, fluid flows within the wellbore. At 438, the flow tube moves until the flow tube locking dog engages a first notch on the frangible flapper valve body to maintain the frangible flapper in the biased open position. At 440, the shifting tool key unlocks from the shifting notch on the flow tube. At 442, the shifting tool decouples from the flow tube.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

The invention claimed is:

1. A wellbore fluid flow control method comprising:

deploying a flapper reservoir isolation valve in a wellbore before wellbore stimulation, the flapper reservoir isolation valve comprising:

a frangible flapper valve body defining a first notch;

a frangible flapper disposed in the frangible flapper valve body and a flow tube disposed in the frangible flapper valve body, wherein the flow tube comprises a flow tube locking dog engagable to the first notch to engage the frangible flapper valve body to the flow tube and to maintain the frangible flapper in a biased open position allowing fluid flow;

moving the flow tube longitudinally in a first direction within the wellbore and relative to the frangible flapper, wherein the flow tube defines a notch, wherein moving the flow tube longitudinally in the first direction further comprises:

coupling a shifting tool to the notch defined by the flow tube to a key, the key and the notch configured to move the flow tube to maintain the frangible flapper in the biased open position allowing fluid flow and an unbiased shut position stopping fluid flow;

jarring the shifting tool and the flow tube in the first direction to disengage the flow tube locking dog from the first notch of the frangible flapper valve body;

responsive to moving the flow tube longitudinally in the first direction, disengaging the flow tube from the frangible flapper;

responsive to disengaging the flow tube from the frangible flapper, causing the frangible flapper to move from the biased open position to the unbiased shut position within the wellbore; and responsive to the frangible flapper moving to the unbiased shut position, stopping fluid flow within the wellbore from a downhole location downhole of the frangible flapper; and after the wellbore stimulation, destroying the frangible flapper to re-open fluid flow through the wellbore to allow a flowback of the fluid flow to the surface of the Earth.

2. The method of claim 1, wherein disengaging the flow tube from the frangible flapper responsive to longitudinally moving the flow tube in the first direction comprises disengaging the flow tube locking dog from the first notch.

3. The method of claim 1, further comprising:

during wellbore stimulation, moving the flow tube longitudinally in a second direction opposite the first direction within the wellbore and relative to the frangible flapper;

responsive to moving the flow tube longitudinally in the second direction, engaging the flow tube to the frangible flapper, wherein engaging the flow tube to the frangible flapper responsive to longitudinally moving the flow tube in the second direction comprises disengaging the flow tube locking dog from a second notch;

responsive to engaging the flow tube, causing the frangible flapper to move from the unbiased shut position to the biased open position within the wellbore;

responsive to the frangible flapper moving to the biased open position, allowing fluid flow within the wellbore;

jarring the shifting tool and the flow tube in the first direction to disengage the flow tube locking dog from the first notch of the frangible flapper valve body;

responsive to moving the flow tube longitudinally in the first direction, disengaging the flow tube from the frangible flapper;

responsive to disengaging the flow tube from the frangible flapper, causing the frangible flapper to move from the biased open position to the unbiased shut position within the wellbore; and responsive to the frangible flapper moving to the unbiased shut position, stopping fluid flow within the wellbore from the downhole location downhole of the frangible flapper.

4. The method of claim 3, wherein the flow tube is moved until the flow tube locking dog engages the first notch defined by the frangible flapper valve body spaced apart from the second notch on the frangible flapper valve body and to maintain the frangible flapper in the biased open position allowing fluid flow.

5. The method of claim 4, wherein the flow tube defines the notch, wherein moving the flow tube longitudinally in a second direction opposite the first direction within the wellbore and relative to the frangible flapper comprises:

coupling the shifting tool to the notch of the flow tube, wherein the shifting tool is coupled to the notch of the flow tube with the key; and jarring the shifting tool and the flow tube in the second direction to disengage the flow tube locking dog from the second notch of the frangible flapper valve body.

6. The method of claim 3, wherein the flow tube is moved until the flow tube locking dog engages the second notch defined by the frangible flapper valve body and spaced apart from the first notch on the frangible flapper valve body, wherein the frangible flapper transitions from the biased open position to the unbiased shut position.

7. The method of claim 1, further comprising moving the shifting tool within the wellbore using a slickline cable or a coiled tubing.

8. The method of claim 1, further comprising destroying the frangible flapper with a blind box or a completion tubing tailpipe.

* * * * *